US007453205B2

(12) United States Patent
Ritz et al.

(10) Patent No.: US 7,453,205 B2
(45) Date of Patent: Nov. 18, 2008

(54) HIGH-PRESSURE GAS DISCHARGE LAMP

(75) Inventors: Arnd Ritz, Heinsberg (DE); Kai Graβie, Stolberg-Breinig (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/515,469

(22) PCT Filed: May 16, 2003

(86) PCT No.: PCT/IB03/01894

§ 371 (c)(1),
(2), (4) Date: Nov. 22, 2004

(87) PCT Pub. No.: WO03/100820

PCT Pub. Date: Dec. 4, 2003

(65) Prior Publication Data

US 2005/0236996 A1 Oct. 27, 2005

(30) Foreign Application Priority Data

May 24, 2002 (EP) ..... 10222954

(51) Int. Cl.
*H01J 11/00* (2006.01)
*H01J 17/16* (2006.01)

(52) U.S. Cl. ..... 313/567; 313/635

(58) Field of Classification Search ..... 315/49, 315/56; 313/567, 621, 623–625, 634–635
See application file for complete search history.

(56) References Cited

U.S. PATENT DOCUMENTS

| | | | | |
|---|---|---|---|---|
| 2,945,146 | A * | 7/1960 | Meyer | 313/113 |
| 3,621,322 | A * | 11/1971 | Rehmet et al. | 313/571 |
| 5,017,839 | A | 5/1991 | Arlt et al. | 315/219 |
| 5,059,865 | A | 10/1991 | Bergman et al. | 315/82 |
| 5,221,876 | A * | 6/1993 | Bergman et al. | 315/82 |
| 5,363,007 | A * | 11/1994 | Fromm et al. | 313/25 |
| 5,608,227 | A | 3/1997 | Dierks et al. | 250/492.1 |
| 5,676,579 | A | 10/1997 | Parham et al. | 445/58 |
| 5,952,768 | A | 9/1999 | Strok et al. | 313/110 |
| 6,504,323 | B2 * | 1/2003 | Yuda et al. | 315/307 |

FOREIGN PATENT DOCUMENTS

| | | |
|---|---|---|
| DE | 10151267 | 4/2003 |
| EP | 0682356 A2 | 11/1995 |
| EP | 0780880 A1 | 6/1997 |

* cited by examiner

*Primary Examiner*—Thuy Vinh Tran

(57) ABSTRACT

The invention relates to a high-pressure gas discharge lamp which comprises at least a lamp bulb (1) hermetically enclosing a discharge space (21) filled with a gas, a functional layer (3), and a light emission opening (5), the latter two being arranged on the outer surface of the lamp bulb, wherein a second layer (4) covers further regions of the surface of the lamp bulb which do not serve the purpose of the functional layer, while the lamp can be operated at a power such that, given the power level of the lamp, a devitrification of the lamp bulb (1) and a condensation of the gas are substantially prevented.

9 Claims, 1 Drawing Sheet

HIGH-PRESSURE GAS DISCHARGE LAMP

Figure 1:
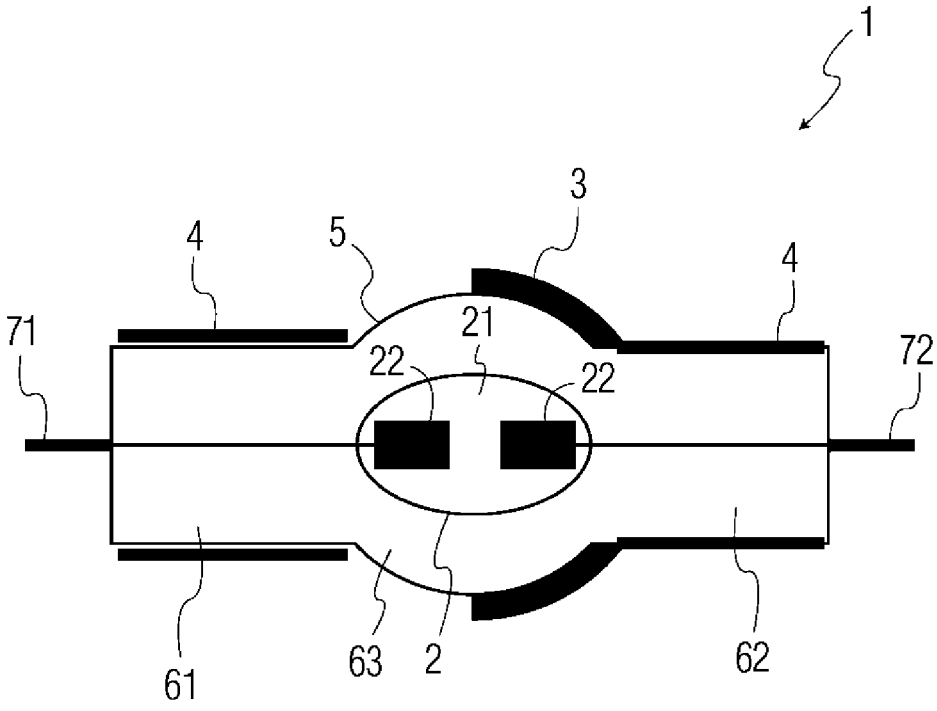

The invention relates to a high-pressure gas discharge lamp which comprises at least a lamp bulb hermetically enclosing a gas-filled discharge space, a functional layer, and a light emission opening, the latter two being arranged on the outer surface of the lamp bulb.

High-pressure gas discharge lamps (HID [high intensity discharge] lamps), and in particular UHP (ultra high performance) lamps are used by preference inter alia for projection purposes because of their optical properties. Within the scope of the invention, the term UHP lamp (Philips) also comprises UHP-type lamps from other manufacturers.

A light source which is as point-shaped as possible is required for these applications, which means that the light arc arising between the electrode tips should not exceed a length of approximately 0.5 to 2.5 mm. Furthermore, a brightness which is as high as possible in combination with as natural as possible a spectral composition of the light is desired.

It is known from DE 101 51 267 that a luminous efficacy rise in optical projection systems can be achieved through external reflectorizing of a portion of the outer surface of the discharge space. The back reflector, which is in particular constructed as a layer, must have at least one opening in this solution, which opening is regularly positioned with respect to the back reflector and renders possible the desired light emission in the direction of the main reflector of the high-pressure gas discharge lamp. The manufacture of such an opening involves a major technological effort, in particular in the case of a mass manufacturing process.

There is an additional demand for functional layers serving various purposes in further applications in lighting technology. These layers may be provided both on the inner and/or on the outer side of the lamp bulb. Among such functional layers are, for example, UV-absorbing layers in the case of automobile lamps, IR-reflecting layers on halogen lamps, or phosphor layers in the interior of luminescent lamps. It is a feature in the applications mentioned above that the coating must or can cover the entire surface area of the lamp bulb, which positively influences the effectiveness of the manufacture of these layers.

If high-pressure gas discharge lamps, in particular UHP lamps, are to be used, however, two essential requirements must be fulfilled simultaneously in their further development.

On the one hand, the highest temperature at the inner surface of the discharge space must not become so high that a devitrification of the lamp bulb, usually made of quartz glass, takes place. This may be a problem because the strong convection inside the discharge space of the lamp heats the region above the light arc particularly strongly.

On the other hand, the coldest spot at the inner surface of the discharge space must have such a high temperature that the mercury is not deposited there, but remains in the vapor state in a sufficient overall quantity. This is to be observed in particular in lamps with saturated gas fillings.

These two mutually contradicting requirements have the result that the maximum admissible difference between the highest and the lowest temperature (usually at the upper and the lower inner side of the discharge space) is comparatively small. If this high-pressure gas discharge lamp is operated at the loading limit of the construction materials, any change in the temperature field, for example a temperature rise, may adversely affect the performance parameters, such as lamp life. Staying within the maximum difference, and accordingly maintaining the optimum operating point, is comparatively difficult, however, because the internal convection mainly heats the region above the discharge space, and the heat conductivity of this region can be increased only within narrow limits through a suitable construction of the lamp bulb, for example by means of a greater wall thickness.

This optimized system reacts very sensitively to measures that influence or change the temperature field in the discharge space. The provision of a reflecting layer on the upper surface is such a measure, whereby the operating temperature of the UHP lamp will normally rise as compared with such a lamp without a coating. This is caused inter alia by the fact that an increased reabsorption takes place owing to a multiple reflection inside the lamp. The coating in addition often leads to a reduction in the heat radiation of the lamp surface as compared with the pure quartz surface of an uncoated lamp, so that the lamp can emit less heat and the operating temperature is accordingly relatively increased.

The size of the coated surface is kept as small as possible so as to achieve as small as possible a change in the temperature field, which change may cause a devitrification of the lamp bulb or a condensation of the gas during operation of these high-pressure gas discharge lamps at their loading limit, at a given power consumption of the lamp, which effects are caused by a coating. The partial coating of a highly loaded lamp which has thus become necessary leaves uncoated not only that surface of the bulb that is necessary for obtaining the optical function, for example the light emission window, but in addition all those surfaces which do not contribute directly to the respective functionality. If a UHP lamp is used, for example, in a projection system, it is not only the light emission opening, but also the ends of the lamp adjoining the spherical discharge vessel which are left uncoated. The manufacture of such a partial coating minimized with regard to its functional effect requires a considerable technological effort and is not very effective. Such a lamp bulb requires at least two mutually separated regions which are to be covered during the coating process so as to prevent a coating thereof. While the coating is being provided, for example, screens are used for covering, which partly prevent the coating. The use of means for covering or means with a comparable function render the coating process more intricate, so that additional technical provisions and process steps become necessary, which together adversely affect the efficiency of the manufacturing process. This solution, which is technically possible in principle, is only feasible in mass manufacture with a considerable technological effort, if at all. There is accordingly an immediate demand for a more efficient solution to this problem.

It is accordingly an object of the invention to provide a high-pressure gas discharge lamp of the kind mentioned in the opening paragraph which is suitable in particular for projection purposes, and to provide a lighting unit, of which the lamp bulb has a partial coating which can be efficiently manufactured and whose optical efficiency is improved.

The object of the invention is achieved in that a second layer covers further regions of the surface of the lamp bulb which do not serve the purpose of the functional layer, while the lamp can be operated at a power such that a devitrification of the lamp bulb and a condensation of the gas are substantially prevented at the power consumption level of the lamp.

A substantial advantage of this solution is that the increase in efficiency, in particular in optical projection systems, achievable through reflectorizing of a portion of the outer surface of the spherical discharge space can be utilized, while the spectral properties of the light remain at a high level. This may be realized in a surprisingly simple manner in that the outer surface of the lamp bulb that is coated is dimensioned as large as possible according to the invention. In the ideal case, the entire outer surface area of the lamp bulb is coated with the exception of the region serving as the light emission window.

The solution according to the invention is based on results obtained from experiments with UHP lamps, i.e. experiments with and without coatings on the lamp ends thereof. These results led to the surprising recognition that lamps having a coating on their lamp ends do indeed become hotter during operation in total, but that a comparable temperature distribution adjusts itself across the surfaces of the lamp bulb within the measuring accuracy of the temperature determination. The conversion of this recognition according to the invention into a technical solution renders possible a substantial simplification of the lamp manufacturing process. In particular, only the region of the light emission opening must remain uncoated owing to suitable measures in the coating process.

Functional layers in the sense of the invention are layers whose main functions are to achieve a defined parameter change of a high-pressure gas discharge lamp.

The dimensioning, the positioning, and the shape of the functional layer and of the light emission window, as well as their relative locations, are dependent on the respective lamp type, also including the accompanying main reflector, and the envisaged application of the lamp, which can be realized in a known manner. It should be noted here that in particular multiple reflections are to be avoided as much as possible when making this choice, so that no reduction in the light output is caused thereby, if at all possible.

The back reflector usually has an opening opposite the main reflector, through which opening the light of the light source is reflected onto the main reflector.

The choice of materials for the functional layer and the second layer as well as the method of applying the respective layers will take place in accordance with the prior art and are made to suit the respective application. The material chosen should lead to as low as possible an absorption.

In addition, these materials must have a sufficient temperature resistance if they are to be provided on a UHP lamp.

It is true in particular for the outer shape of the central portion of the lamp bulb, comprising the discharge space, that this should be either substantially spherical or elliptical. In the case of a spherical shape, the light arc should be centered in the center of the sphere. In the case of an ellipse, the distance between the two focuses should not be greater than the distance between the tips of the two electrodes, while said focuses should lie within the light arc.

The dependent claims relate to advantageous further embodiments of the invention.

An embodiment which is advantageous for a particularly effective manufacture can be achieved in accordance with claim 2.

The embodiment of claim 3 prefers UHP lamps.

It is preferred, according to claim 4, that the functional layer or the functional layer and the second layer covers or cover substantially all regions of the surface of the lamp bulb.

It is particularly favorable, according to claim 5, that the functional layer is a back reflector with dichroic properties or an interference filter.

The dichroic properties of the functional layer have the result that only certain preferred spectral ranges of the light are radiated to the exterior.

The material of low refractive index chosen in accordance with claim 6 is preferably silicon oxide ($SiO_2$), which corresponds to the highest possible degree to the material of the lamp bulb. A plurality of materials may be chosen as the material of higher refractive index, such as $TiO_2$, $ZrO_2$, and $Ta_2O_5$. $ZrO_2$ is particularly preferred here, because it absorbs less than most other materials.

Besides the materials mentioned above and mixtures thereof, further materials may be used within the scope of the invention, which materials may be tested for their usefulness, for example by means of suitable experiments.

Preferred methods of manufacturing the functional layers in the sense of the invention are known standard methods of thin-film technology, in particular physical vapor deposition, sputtering, chemical vapor deposition, and dipping.

The object of the invention is additionally achieved by means of a lighting unit comprising at least one high-pressure gas discharge lamp as claimed in any one of the claims 1 to 6.

Such a lighting unit or high-pressure gas discharge lamp may be used in particular for projection purposes.

Further details, features, and advantages of the invention will become apparent from the ensuing description of a preferred embodiment, which is given with reference to the drawing, in which:

The Figure is a diagrammatic cross-sectional view of a lamp bulb with a discharge space of a high-pressure gas discharge lamp (UHP lamp).

The Figure is a diagrammatic cross-sectional view of a lamp bulb 1 with a discharge space 21 of a high-pressure gas discharge lamp (UHP lamp) according to the invention. The lamp bulb 1, which is in one integral whole and which hermetically seals off the discharge space 21 filled with a gas usual for this purpose, and whose material is usually hard glass or quartz glass, comprises two cylindrical, mutually opposed regions 61, 62 between which a substantially spherical region 63 with a diameter in the range of between approximately 8 mm and 14 mm is present. The elliptical discharge space 21 with an electrode arrangement 2 is centrally arranged in the region 63. The electrode arrangement 2 comprises substantially a first electrode 22 and a second electrode 23, between whose mutually opposed tips a luminous arc discharge is excited in the discharge space 21, which luminous arc serves as a light source of the high-pressure gas discharge lamp. The ends of the electrodes 22, 23 are connected to electrical connectors 71, 72 of the lamp via which the supply voltage necessary for operating the lamp is fed in by a power supply unit (not shown in FIG. 1) designed to operate on a public mains voltage.

The functional layer 3 and the light emission opening 5 are arranged on the outer surface of the region 63. The functional layer 3 has a total thickness of approximately 3 .mu.m, and consists of several layers, being constructed as a so-termed cool-light mirror in the form of an interference filter. These sub-layers (not shown in the figure) are characterized in particular by mutually differing refractive indices, such that a sub-layer of lower index alternates with one of higher index a number of times. The material with the lower refractive index is, for example, SiO.sub.2; that with the higher index, for example, ZrO.sub.2.

The layer 4, which is also formed by several sub-layers of $SiO_2$ and $ZrO_2$, is provided on the cylindrical regions 61, 62, but this layer may differ from the layer 3 in its quality, in particular as regards the evenness of its thickness. The coating with the functional layer 3 and with the layer 4 usually takes place in one manufacturing process. Any minor layer thickness fluctuations and inhomogeneities arising in the manufacturing process may usually be accepted in view of the reduced quality requirements for the layer 4 as compared with the functional layer 3. Furthermore, additional costs for quality checks and the resulting rejects are avoided.

A UHP lamp with the lamp bulb 1 as described above was operated at its rated power of 120 W for several thousands of hours in the range of its upper loading limit, whereupon no substantial impairments could be detected in excess of the normal aging effects of comparable lamps with only partial coatings.

A particularly advantageous embodiment of the invention is formed by a high-pressure gas discharge lamp constructed as a short-arc lamp and serving for projection purposes.

The invention claimed is:

1. A high-pressure gas discharge lamp which comprises at least a lamp bulb (1) hermetically enclosing a gas-filled discharge space (21), a functional layer (3), and a light emission opening (5), the latter two being arranged on an outer surface of a substantially elliptical or spherical region of the lamp bulb, wherein a second layer entirely covers mutually opposed cylindrical regions of the lamp bulb (1), arranged at respective ends of said substantially elliptical or spherical region of the lamp bulb (1), while the lamp is operated at a power such that a devitrification of the lamp bulb (1) and a condensation of the gas are prevented at the power consumption level of the lamp, wherein the functional layer is an interference filter comprised in particular of layers of $SiO_2$ and $ZrO_2$, and wherein the functional layer has a total thickness of at least 3 mum and the functional layer is partially co-extensive with the light emission opening, and wherein the second layer is comprised in particular of layers of $SiO_2$ and $ZrO_2$.

2. A high-pressure gas discharge lamp as claimed in claim 1, wherein the second layer (4), which covers further regions of the surface of the lamp bulb (1), is different from the functional layer (3) as regards its build-up and/or material composition.

3. A high-pressure gas discharge lamp as claimed in claim 1, wherein said lamp is a UHP lamp.

4. A high-pressure gas discharge lamp as claimed in claim 1 is designed for projection purposes.

5. A high-pressure gas discharge lamp which comprises at least a lamp bulb hermetically enclosing a gas-filled discharge space, a functional layer, and a light emission opening, the latter two being arranged on an outer surface of a substantially elliptical or spherical region of the lamp bulb, wherein a second layer entirely covers mutually opposed cylindrical regions of the lamp bulb (1), arranged at respective ends of the substantially elliptical or spherical region, while the lamp is operated at a power such that a devitrification of the lamp bulb (1) and a condensation of the gas are prevented at the power consumption level of the lamp, wherein the functional layer is an interference filter comprised of multiple sub-layers, each sub-layer having a refractive index different from a refractive index of one of the multiple layers that is contiguous to it, wherein the functional layer is partially co-extensive with the light emission opening, and wherein the second layer is comprised in particular of layers of $SiO_2$ and $ZrO_2$.

6. A high-pressure gas discharge lamp comprising a lamp bulb hermetically enclosing a gas-filled discharge space, a functional layer, and a light emission opening, the latter two being arranged on an outer surface of a substantially elliptical or spherical region of the lamp bulb, wherein a second layer entirely covers mutually opposed cylindrical regions of the lamp bulb (1), arranged at respective ends of the substantially elliptical or spherical region of the lamp bulb (1), the lamp being operable at a power such that both a devitrification of the lamp bulb and a condensation of the gas are substantially prevented, wherein the functional layer and the second layer are comprised of multiple sub-layers of the same material and the functional layer is partially co-extensive with the light emission opening, and wherein the multiple sub-layers alternate with one of higher refractive index being followed by another of the sub-layers having lower refractive index.

7. A high-pressure gas discharge lamp comprising at least a lamp bulb hermetically enclosing a gas-filled discharge space, a functional layer, and a light emission opening, the latter two being arranged on an outer surface of a substantially elliptical or spherical region of the lamp bulb, wherein a second layer entirely covers mutually opposed cylindrical regions of the lamp bulb (1), arranged at respective ends of the substantially elliptical or spherical region of the lamp bulb (1), the lamp being operable at a power such that both a devitrification of the lamp bulb and a condensation of the gas are substantially prevented, wherein the functional layer is partially co-extensive with the light emission opening.

8. A lighting unit comprising a high-pressure gas discharge lamp which comprises at least a lamp bulb (1) hermetically enclosing a gas-filled discharge space (21), a functional layer (3), and a light emission opening (5), the latter two being arranged on an outer surface of a substantially elliptical or spherical region of the lamp bulb, wherein a second layer entirely covers mutually opposed cylindrical regions of the lamp bulb (1), arranged at respective ends of the substantially elliptical or spherical region of the lamp bulb (1), while the lamp is operated at a power such that a devitrification of the lamp bulb (1) and a condensation of the gas are substantially prevented at the power consumption level of the lamp, wherein the functional layer is an interference filter comprised in particular of layers of $SiO_2$ and $ZrO_2$, wherein the functional layer has a total thickness of at least 3 mum, and wherein the functional layer is partially co-extensive with the light emission opening, and wherein the second layer is comprised in particular of layers of $SiO_2$ and $ZrO_2$.

9. A projection device comprising a high-pressure gas discharge lamp which comprises at least a lamp bulb (1) hermetically enclosing a gas-filled discharge space (21), a functional layer (3), and a light emission opening (5), the latter two being arranged on an outer surface of a substantially elliptical or spherical region of the lamp bulb, wherein a second layer entirely covers mutually opposed cylindrical regions of the lamp bulb (1), arranged at respective ends of the substantially elliptical or spherical region of the lamp bulb (1), while the lamp is operated at a power such that a devitrification of the lamp bulb (1) and a condensation of the gas are substantially prevented at the power consumption level of the lamp, wherein the functional layer is an interference filter comprised in particular of layers of $SiO_2$ and $ZrO_2$, wherein the functional layer has a total thickness of at least 3 mum, and wherein the functional layer is partially co-extensive with the light emission opening, and wherein the second layer is comprised in particular of layers of $SiO_2$ and $ZrO_2$.

* * * * *